US007745744B2

(12) United States Patent
Nakase et al.

(10) Patent No.: US 7,745,744 B2
(45) Date of Patent: Jun. 29, 2010

(54) MULTIDIRECTIONAL SWITCH

(75) Inventors: Yu-Sho Nakase, Yokohama (JP); Shi-Jie Tan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 395 days.

(21) Appl. No.: 11/789,137

(22) Filed: Apr. 24, 2007

(65) Prior Publication Data

US 2007/0246343 A1 Oct. 25, 2007

(30) Foreign Application Priority Data

Apr. 24, 2006 (TW) ..... 95206943 U

(51) Int. Cl.
*H01H 25/00* (2006.01)

(52) U.S. Cl. ..... 200/6 A; 200/5 R; 200/406

(58) Field of Classification Search ..... 200/5 A, 200/5 R, 6 A, 6 R, 17 R, 18, 406
See application file for complete search history.

(56) References Cited

U.S. PATENT DOCUMENTS 6,399,904 B1 * 6/2002 Mimata ..... 200/6 A
6,593,909 B1 * 7/2003 Chou ..... 345/157
7,102,088 B2 * 9/2006 Tan et al. ..... 200/6 A
7,297,883 B2 * 11/2007 Rochon et al. ..... 200/5 R
2006/0016673 A1 * 1/2006 Tan et al. ..... 200/6 A

* cited by examiner

*Primary Examiner*—Renee S Luebke
*Assistant Examiner*—Marina Fishman
(74) *Attorney, Agent, or Firm*—Andrew C. Cheng; Wei Te Chung; Ming Chieh Chang

(57) ABSTRACT

A multidirectional switch (1) comprises an insulative housing (2), a first fixed contact (31) and a third fixed contact (33), a first moveable contact (41) and a second moveable (42) contact disposed above the first fixed contact (31) and the third fixed contact (33), an operation member (5) mounted on the first moveable contact (41) and defining a second pressing portion (53). The second pressing portion (53) presses the second moveable contact (42) in order to make the second moveable contact (42) contact with or separate from the third fixed contact (33). The first moveable contact (41) always contacts with the first fixed contact (31). The second moveable contact (42) is integrated with the first moveable contact (41) and distributed around the first moveable contact (41).

10 Claims, 4 Drawing Sheets

MULTIDIRECTIONAL SWITCH

BACKGROUND OF THE INVENTION

1. Field of the Invention

The present invention relates to a miniature multi-directional switch, and particularly to a multidirectional switch used in consumer electronic applications.

2. Description of the Prior Art

The personal electronic consumer productions such as cell phones are designed to comply with a miniature trend as the customers require. Correspondingly, electronic elements such as switches employed in those productions are required to be miniature.

A conventional multidirectional switch 10' is disclosed in FIG. 4 comprises an insulative housing 1', a first fixed contact (23', 24', 25', 26'), a common contact 22', a second fixed contact 21', a first moveable contact 3', a second moveable contact 5', an operation member 6' and a cover 7'. The first fixed contact (23', 24', 25', 26'), a common contact 22' and the second fixed contact 21' are disposed on the bottom surface 11' of the housing 1'. The first moveable contact 3' is attached on the operation member 6' and moves together which comprises a constant contacting portion and a moveable contacting portion, wherein the constant contacting portion 51' always abuts against the common contact 22'. The second moveable contact 21' is disposed above the second fixed contact 21' and the common contact 22' and comprises a center portion 31' and a fringe portion 32', wherein the fringe portion 32' comes into contact with the common contact 22'. The operating portion 6' is disposed above the second moveable contact 21' and comprises a first pressing portion 63' and a second pressing portion. The housing 1' and the cover 7' cooperatively contain the first fixed contact (23', 24', 25', 26'), the second fixed contact 21', the first moveable contact 3', the second moveable contact 5' and the operating member 6' therein. When pressing the operating member 6' perpendicularly, the second pressing portion presses the second moveable contact 5' downwardly, which make the second moveable contact 5' contact or separate with the second fixed contact 21'. When pressing the operating portion 6' in a slant direction, the first pressing portion 63' presses the moveable contacting portion 52' of the first moveable contact 3', which makes the moveable contacting portion 52' contact or separate with the first fixed contact (23', 24', 25', 26'). Hence, the multidirectional switch 10' can realize the control function thereof.

However, the first moveable contact 3' is separated with the second moveable contact 5', which makes the manufacturing process of the multidirectional switch 10' more complicate. In addition, the moveable contact with bigger size can lead to a bigger size of the whole multidirectional switch, which is not desired.

Hence, an improved multidirectional switch is required to overcome the disadvantages of the prior art.

BRIEF SUMMARY OF THE INVENTION

An object of the present invention is to provide a multidirectional switch which has a simple manufacturing process and a miniature size.

A multidirectional switch in according with the present invention comprises an insulative housing, a first fixed contact and a third fixed contact, a first moveable contact and a second moveable contact disposed above the first fixed contact and the third fixed contact, a operation member mounted on the first moveable contact and defining a second pressing portion, the second pressing portion pressing the second moveable contact in order to make the second moveable contact or separate with the third fixed contact, the first moveable contact always contacting with the first fixed contact, wherein the second moveable contact is integrated with the first moveable contact and distributed around the first moveable contact.

Relative to the present technology, the multidirectional switch in accordance with the invention can decrease the manufacturing process thereof due to the first moveable contact being integrated with the second moveable contact; furthermore, the second moveable contact disposed around the first moveable contact can miniaturize the size of the multidirectional switch.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
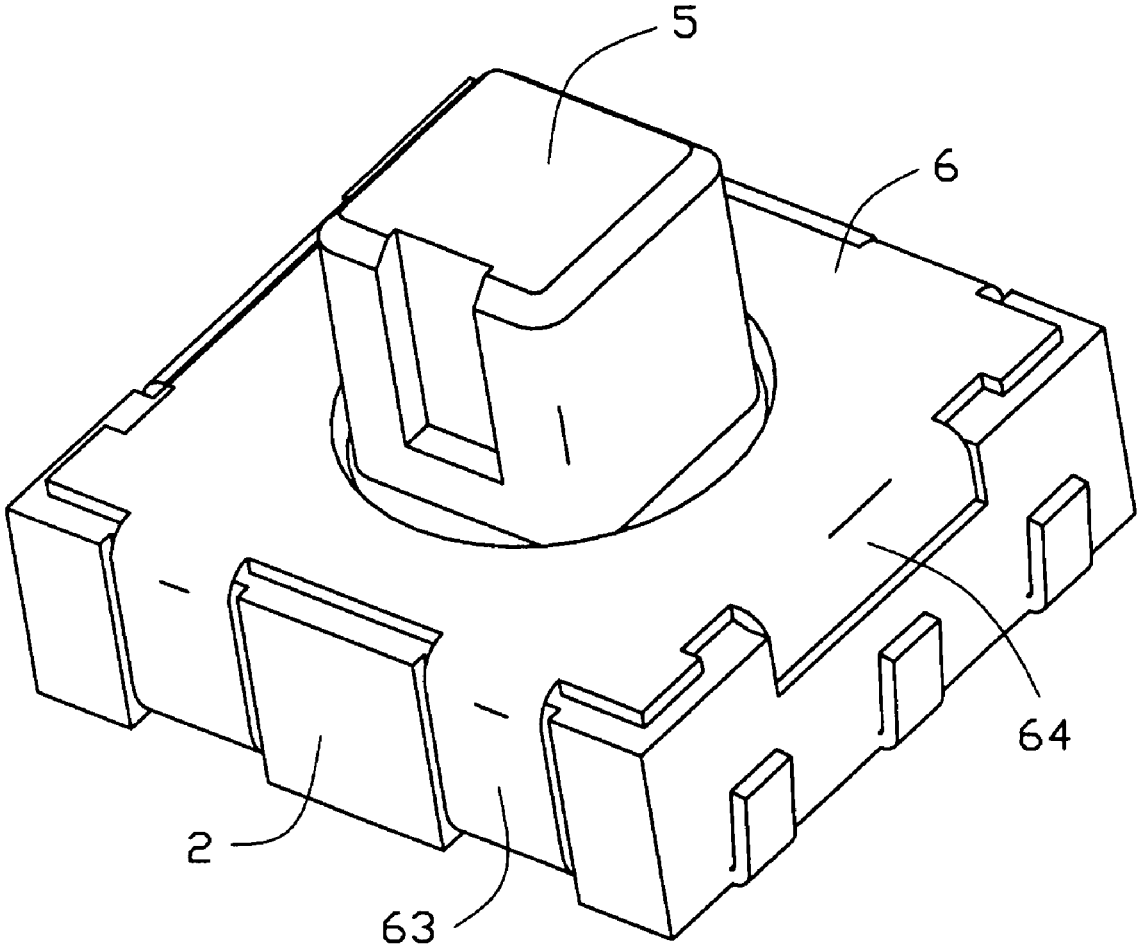
FIG. 1 is an assembled view of a multidirectional switch according to the present invention.
Figure 2:
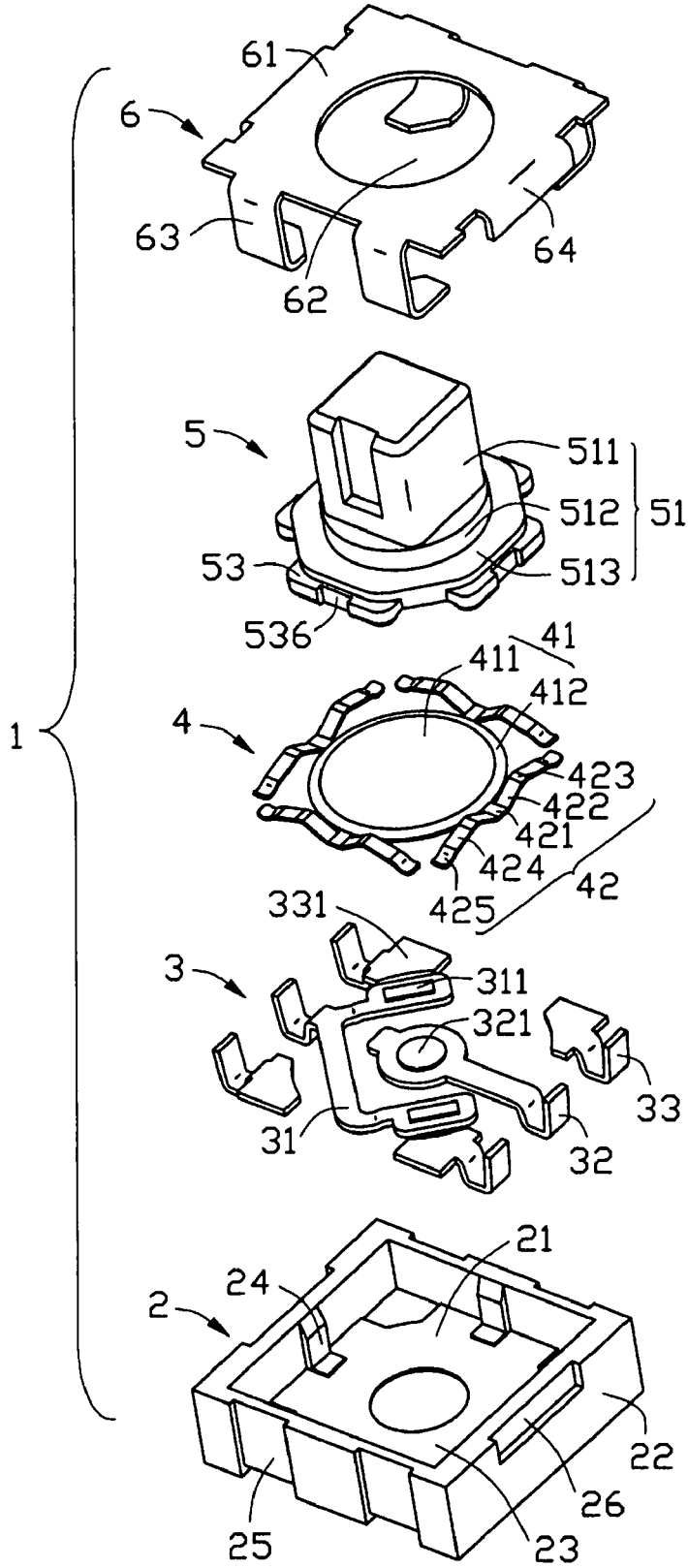
FIG. 2 is an exploded view of the multidirectional switch.
Figure 3:
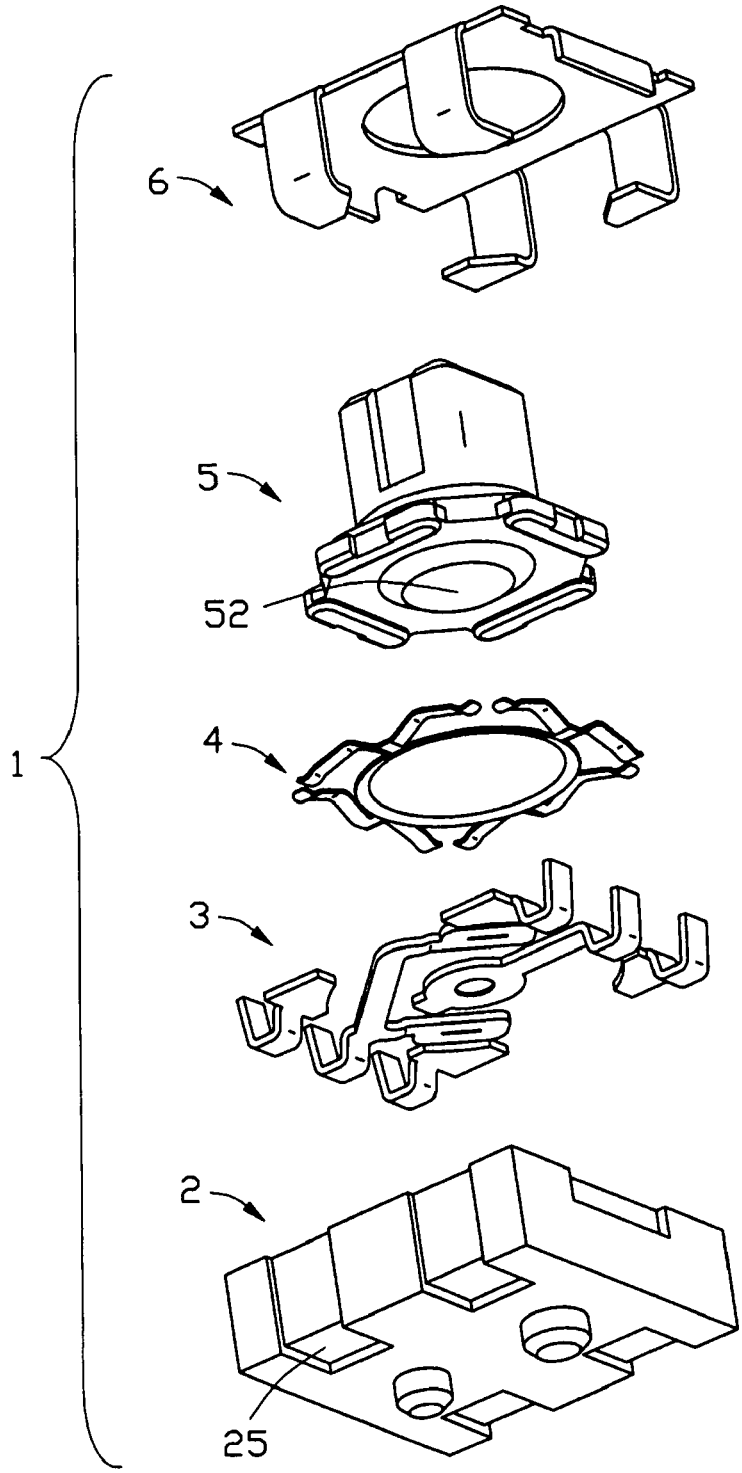
FIG. 3 is an exploded view of the multidirectional switch in an another perspective.
Figure 4:
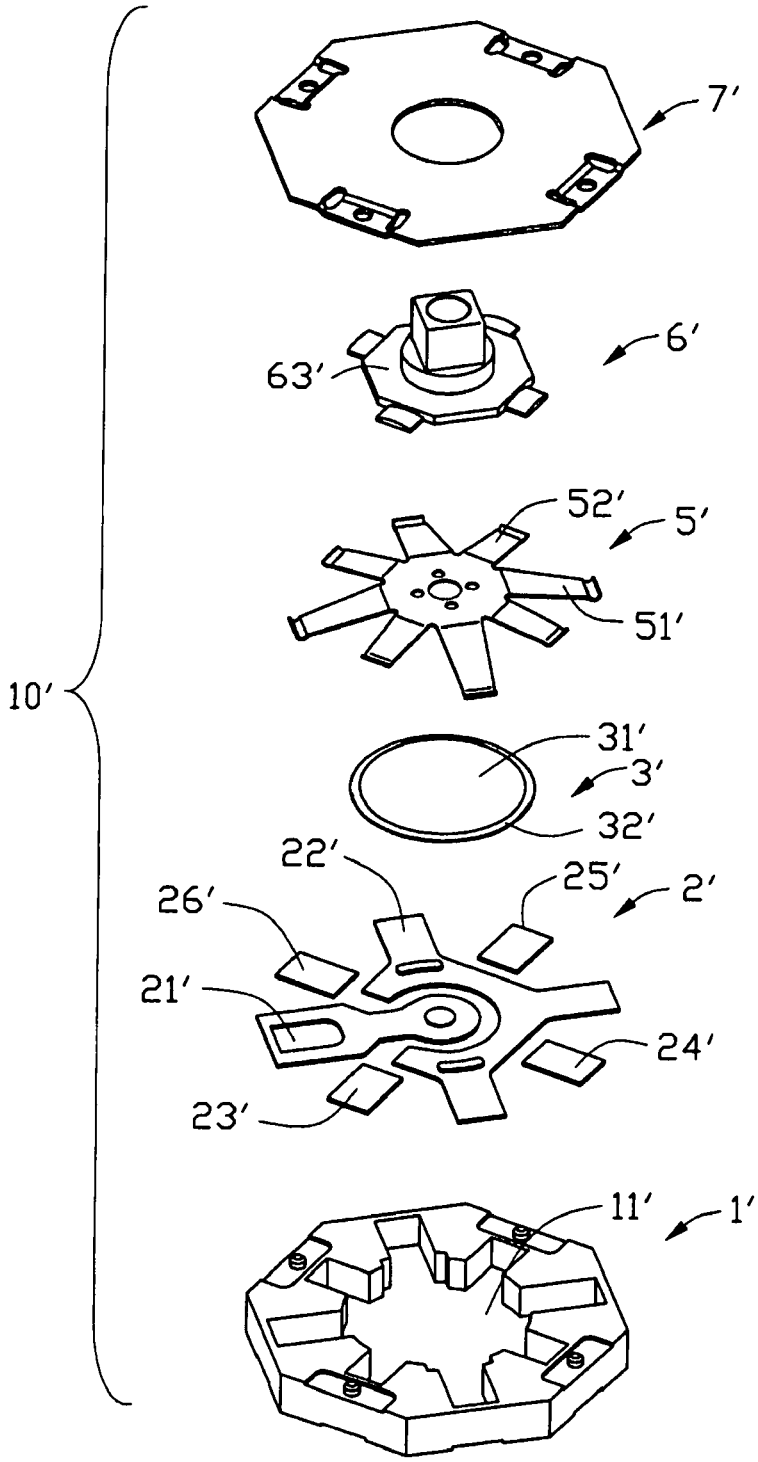
FIG. 4 (Prior Art)
FIG. 4 is an isometric view of a conventional multidirectional switch.

Referring to FIGS. 1, 2 and 3, a multidirectional switch 1 in accordance with the present invention comprises an insulative housing 2, a fixed contact unit 3, a moveable contact 4, an operation member 5 and a cover 6.

The housing 2 is defined as rectangular shape and comprise a bottom surface 21 and four sidewalls 22 extending from the bottom surface perpendicularly and a cavity 23 formed cooperatively by the bottom surface 21 and the sidewalls 22. A protrusion 24 projects from each sidewall 22 towards the cavity 23. A pair of first engaging channels 25 is disposed on two sidewalls opposite to each other and penetrates through each sidewall to the bottom surface 21 respectively in the perpendicular direction. A pair of second engaging channel 26 is disposed on the other two sidewalls 22 and do not penetrate through the sidewalls 22 respectively in the perpendicular direction.

The fixed contact unit 3 comprises a first fixed contact 31, a second fixed contact 32 and a number of third fixed contacts 33, wherein the first fixed contact 31 and the second fixed contact 32 are separated from the third fixed contacts 33. The third contact 33 defines a contact surface 331, the first fixed contact 31 defines a first protrusion 311, the second fixed contact 32 defines a second protrusion 321 and the first protrusion 311 and the second protrusion 321 are located in a same plane.

The moveable contact 4 comprise a first moveable contact 41 and a group of second moveable contacts 42. The first moveable contact 41 comprises a center portion 411 and a fringe portion 412. The second moveable contacts 42 are distributed around the first moveable contact 41. The second moveable contact 42 is disposed as an elongate arcuate sheet and comprise a connecting portion 421 in the center of the sheet for connecting to the fringe portion 412 of the first moveable contact 41. An elastic portion 422 extends upwardly from either side of the connecting portion 421 and comprises a curved contacting portion 423 in an end thereof. A second elastic portion 424 extends downwardly from the contacting portion 423 and defines a pressing portion 425 higher than the connecting portion 421 in an end thereof.

The operating member 5 defines an actuator 51. The actuator 51 comprises a rectangular section 511 and a polygon section 513 and a cylindrical portion 512 defined between the rectangular portion 511 and the polygon section 513. The polygon section 513 protrudes a first pressing portion 56 towards moveable contact 4 in the center thereof and is configured as a partial sphere shape. In addition the operating member 5 defines a second number of pressing portions 53 distributed around the polygon section 513. A recess 536 is defines in a center of the second pressing portion 53 and width of the recess 536 is greater than width of the protrusion 24.

The cover 6 defines a base plate 61. The base plate 61 defines a hole 62 and the diameter of the hole 62 is grater than the outer diameter of cylindrical portion 512 of the operating member 5. Two lateral sides of the base plate 61 extend a plurality of first hooks 63 for engaging with the first engaging channels 25. The other two lateral sides of the base plate 51 extend a plurality of second hooks 64 for engaging with the second engaging channel 26.

In assembling, the fixed contact unit 3 is initially embedded in the bottom surface 21 of the housing 2. The first moveable contact 41 covers the second fixed contact 32, wherein the fringe portion 412 always abuts against the first protrusion 311 of the first fixed contact 31, and the center portion 411 comes into contacting or separating with the second protrusion 321. The second moveable contact 42 can contact with one or two of the third fixed contacts 33. The operating member 5 is disposed above the movable contact 4, wherein the first pressing portion 52 abuts against the center potion 411 of the first movable contact 41 and the recess 536 of the second pressing portion 53 engages with the protrusion 24 of the housing 2, which can make operating member 5 move up-and-down or slantly relative to the housing 2 under the limitation thereof. When the cover mounts on the housing 2, the rectangular section 511 of the operating member 5 penetrates through the hole 62. The cylindrical portion 512 is clear from the hole 62 and the polygon section 513 comes into contact with the base plate 61 of the cover 6 and received in the housing 2. The first hook 63 of the cover 6 engages with first engaging channel 25, the second hook 64 of the cover 6 engages with the second recess 26 of the housing 2, which make the cover 6 position relative to the housing 2.

When no outer force is applied, the center portion 411 of the first moveable contact 41 is separated from the second fixed contact 321, the second moveable contact 42 is separated from the third fixed contact 33 and the fringe portion 411 of the first moveable contact 41 abuts against the first fixed contact 31. In this position, the multidirectional switch 1 is in a breaking state. When an outer force presses the rectangular section in the axis direction of the cylindrical portion 512, the center portion 411 is depressed by the first pressing portion 52 of the first moveable contacts 5. The second fixed contact 32 is separated from the second moveable contact by the third fixed contact 33 and the second fixed contact 32 abuts against the first fixed contact 31. In this position the multidirectional switch is in a closed state. When the actuator 51 is pressed toward the third fixed contact 33 by an outer force, the pressing portion 53 initially press the contacting portion 425 of the second moveable contact 42, which make the contacting portion 425 of the second moveable contact 42 abuts against the contact section 331 of the third fixed contact 33, and then the first pressing portion 52 presses the first moveable contact 41, which make center portion 411 abut against the second fixed contact 32. In this case, the second fixed contact 32 and the first fixed contact 31 can come into contact with the third fixed contact 33, which makes the multidirectional switch 1 produce electrical signals.

In the multidirectional switch 1 in accordance with aforementioned embodiment of the present invention, the first moveable contact 41 is integrated with the second moveable contact 42, which simplifies the manufacturing process of the multidirectional switch 1. In addition the second moveable contact 42 distributed around the first moveable contact 41 can reduce the whole size of the multidirectional switch 1.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

The invention claimed is:

1. A multidirectional switch comprising:

a set of fixed contacts located at a lower level and including:

a center fixed contact;

a first peripheral fixed contact and a plurality of second peripheral fixed contacts commonly located around said centre fixed contact;

a unitary moveable contact located at an upper level and defining a center portion and a plurality of deflectable peripheral portions extending from a fringe of said center portion; wherein the fringe constantly mechanically and electrically engages the first peripheral fixed contact; wherein said deflectable peripheral portions are configured to be capable of engaging the second peripheral fixed contacts respectively.

2. The multidirectional switch as claimed in claim 1, wherein an operation member is located above the movable contact either downwardly pressing the moveable contact to have the center portion electrically and mechanically engages the center fixed contact, or downwardly tilting the moveable contact to have the deflectable peripheral portions electrically and mechanically engage the peripheral fixed contacts, respectively.

3. The multidirectional switch as claimed in claim 1, wherein the fringe of the movable contact is essentially located between the center fixed contact and the peripherally fixed contacts in a top view.

4. The multidirectional switch as claimed in claim 1, wherein said fringe is round.

5. A multidirectional switch comprising:

a set of fixed contacts located at a lower level and including:

a center fixed contact;

a first peripheral fixed contact and a plurality of second peripheral fixed contacts commonly located around said center fixed contact;

a unitary moveable contact located at an upper level and defining a center portion and a plurality of deflectable peripheral portions extending from a fringe of said center portion; wherein the fringe constantly mechanically and electrically engages the first peripheral fixed contact; wherein said deflectable peripheral portions are unitarily connected to the fringe.

6. The multidirectional switch as claimed in claim 5, wherein the fringe engages the first peripheral fixed contacts at two positions.

7. The multidirectional switch as claimed in claim 6, wherein said two positions are arranged diametrically opposite to each other.

8. The multidirectional switch as claimed in claim 5, wherein said deflectable peripheral portions engage the corresponding second peripheral fixed contacts, respectively.

9. The multidirectional switch as claimed in claim 8, wherein each of said second peripheral fixed contacts are engaged with two of said deflectable peripheral portions.

10. The multidirectional switch as claimed in claim 5, wherein said fringe is round.

* * * * *